US005951381A

United States Patent [19]

Videcoq et al.

[11] Patent Number: 5,951,381

[45] Date of Patent: Sep. 14, 1999

[54] GRINDING WHEEL FOR OPHTHALMIC GLASSES AND CORRESPONDING GRINDING MACHINE

[75] Inventors: Jean-Jacques Bernard Joseph Videcoq, Pavilly; Thierry Pierre Yves Lefrancois, Bonsecours, both of France

[73] Assignee: Briot International, Pont de l'Arche, France

[21] Appl. No.: 08/875,089

[22] PCT Filed: Nov. 25, 1996

[86] PCT No.: PCT/FR96/01861

§ 371 Date: Jul. 22, 1997

§ 102(e) Date: Jul. 22, 1997

[87] PCT Pub. No.: WO97/18922

PCT Pub. Date: May 29, 1997

[30] Foreign Application Priority Data

Nov. 23, 1995 [FR] France ..... 95 13960

[51] Int. Cl.[6] ..... B24B 5/00

[52] U.S. Cl. ..... 451/255; 451/42; 451/43; 451/540; 451/542; 451/547; 451/544; 451/240

[58] Field of Search ..... 451/42, 43, 541, 451/255, 240, 256, 277, 323, 540, 542, 547, 544; 125/15

[56] References Cited

U.S. PATENT DOCUMENTS

| | | | |
|---|---|---|---|
| 3,599,377 | 8/1971 | Dartnell | 451/43 |
| 3,802,130 | 4/1974 | Lindenbeck | 451/544 |
| 4,151,685 | 5/1979 | Frangipane | 451/544 |
| 4,720,942 | 1/1988 | Miller | 451/547 |
| 5,218,948 | 6/1993 | Mazaki | 125/15 |
| 5,321,915 | 6/1994 | Lecert et al. | 451/240 |
| 5,406,929 | 4/1995 | Uderf et al. | 451/449 |
| 5,441,033 | 8/1995 | Chiuminatta et al. | 125/15 |

FOREIGN PATENT DOCUMENTS

| | | | |
|---|---|---|---|
| 4304128 | 8/1993 | Germany | 451/544 |

*Primary Examiner*—Robert A. Rose
*Assistant Examiner*—George Nguyen
*Attorney, Agent, or Firm*—Wenderoth, Lind & Ponack, L.L.P.

[57] ABSTRACT

A diamond-charged abrasive layer (3) of a grinding wheel has a convex profile over at least part of its length (L) in order to have greater resistance to wear. Also provided is a machine for grinding ophthalmic lenses which employs the grinding wheel.

23 Claims, 1 Drawing Sheet

GRINDING WHEEL FOR OPHTHALMIC GLASSES AND CORRESPONDING GRINDING MACHINE

BACKGROUND OF THE INVENTION

The present invention relates to a grinding wheel for the grinding of ophthalmic glass blanks, of the type comprising a disc-shaped core which carries a diamond-charged abrasive layer on its periphery.

Such a grinding wheel is intended for equipping a grinding machine, in particular an automatic one, which can be used for routing the blanks of spectacles or glasses.

To fit an ophthalmic glass in the circle or surround of a spectacle frame, a generally circular glass blank is taken as a starting point, and then this blank is routed to the contour of the frame circle. The blank routed in this manner is subsequently passed to a finishing station.

The routing of ophthalmic lenses is usually carried out on an automatic grinding machine. This machine possesses one or more abrasive grinding wheels which are driven in rotation at high speeds and serve as tools for cutting the edge of the spectacle glasses.

When the lenses to be ground are mineral glasses, the grinding wheel must comprise a diamond-charged abrasive layer, and this abrasive layer is carried out by a disc-shaped rigid metal core.

Automatic grinding machines generally comprise a wheel-holding shaft provided with means for driving in rotation at high speeds, and means for supporting a glass blank, which is designed to cause the blank to rotate at a slow rotational speed along a supporting axis parallel to the wheel-holding shaft. The machine also includes means for varying the distance between the two axes as a function of angular position of the blank about the supporting axis.

During the use of the grinding wheel, it has been discovered that a middle part of the length of the grinding wheel undergoes more rapid wear. It is therefore necessary to change the grinding wheel well before the entire abrasive layer is worn. This is particularly troublesome in view of the high costs of diamond-charged products.

SUMMARY OF THE INVENTION

The object of the present invention is to extend the life of the grinding wheel relatively economically. For this purpose, the subject of the invention is a grinding wheel of the abovementioned type, wherein the abrasive layer has a convex profile over at least part of its length.

Another subject of the invention is a machine for the grinding of ophthalmic lenses comprising a grinding wheel, as defined above.

BRIEF DESCRIPTION OF THE DRAWINGS

Exemplary embodiments of the invention will now be described with reference to the accompanying drawing in which.

DETAILED DESCRIPTION OF THE INVENTION

Figure 1:
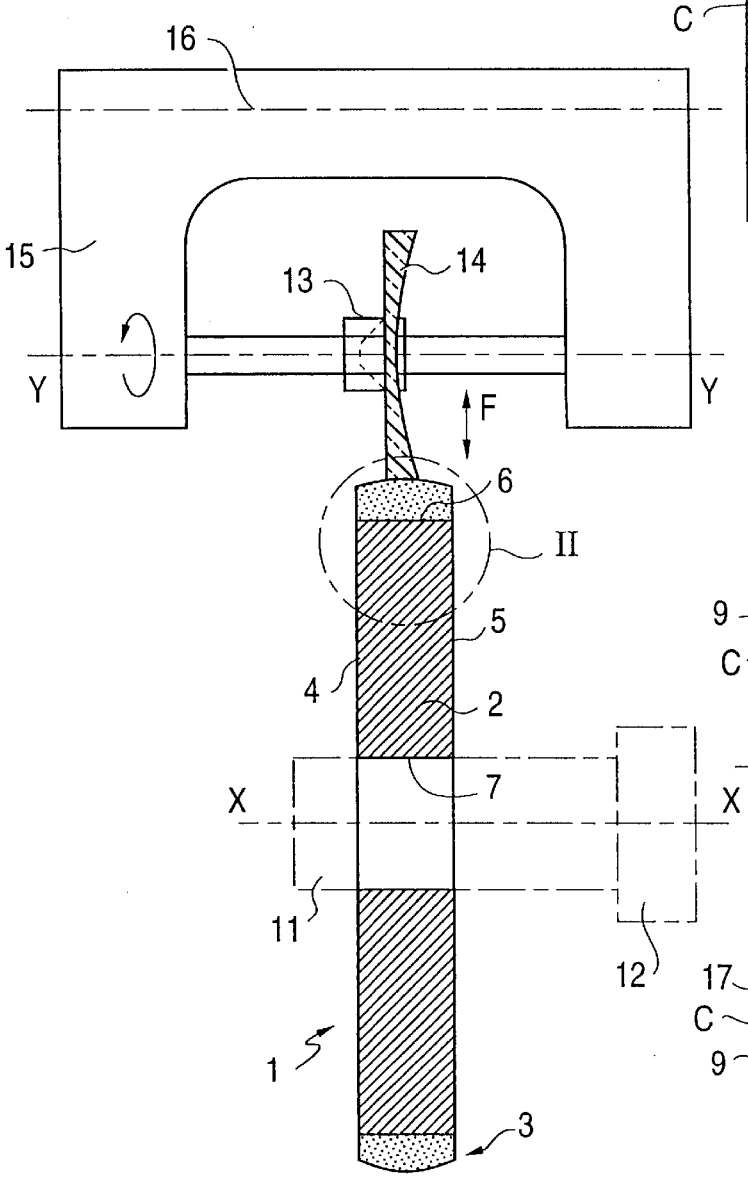
FIG. 1 is a view in axial section of a grinding wheel according to the present invention, this view diagrammatically illustrates associated parts of an automatic grinding machine.
Figure 2:
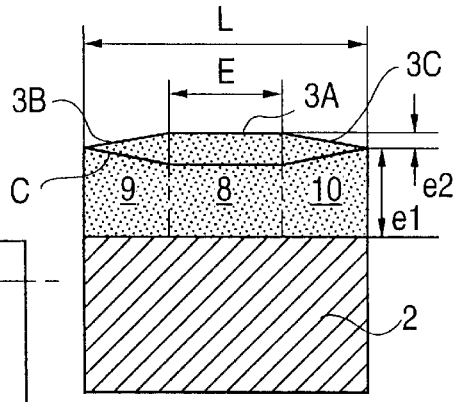
FIG. 2 shows region II of FIG. 1 on a larger scale.

A grinding wheel 1 is illustrated in FIGS. 1 and 2 consists of body or core 2 and of an abrasive layer 3.

The body 2 is a metal disc having a central axis X—X. The body 2 is delimited by two radial planar faces 4, 5 and by a cylindrical peripheral surface 6 having a circular cross-section. The body 2 is pierced with an axial orifice 7.

The abrasive layer 3 extends axially over the entire length L of the body 2. The abrasive layer 3 consists of grains of synthetic diamond which are coated in a binder, and it has a homogeneous composition.

The abrasive layer 3 is subdivided over the length L into three portions: in the middle, a portion having a relatively high constant thickness e1+e2 and, on either side of portion 8, two portions 9, 10 having a thickness which decreases progressively from e1+e2 to e1. The e1 value is reached at each axial end of the grinding wheel. As an example, e1 may be selected as being of the order of 2 mm and e2 of the order of 0.5 mm.

The meridian cross-section of the layer 3 thus has a profile consisting of three segments of a straight line: a central segment 3A, parallel to the axis X-X-, which is framed by two inclined segments 3B and 3C.

The length E of the portion 8 may be between ⅕ and ⅘ of the total length L and is generally between ⅓ and ⅔ of this length.

In operation, the grinding wheel 1 is fastened on a drive shaft 11 of an automatic grinding machine by means of orifice 7, by a suitable keying means. The shaft 11 is connected to a motor 12 for high-speed rotation about the axis X—X. The motor 12 is fixed relative to the stand of the machine.

The automatic grinding machine comprises, furthermore, a removable fastening means 13, for example of the sucker type, which make it possible to position, for example, an initially circular blank 14 of especially mineral ophthalmic glass and to cause the blank to rotate at a low speed about a supporting axis Y—Y which is parallel to the axis X—X. This axis Y—Y may be the axis of the blank 14 or it may be offset slightly relative to the blank axis. The length L of the grinding wheel to be ground, of the order 2 cm, is slightly greater than the edge of the thickest portion of blank 14 which may be of a divergent or a concave type.

The machine also comprises means which makes it possible to move the axis Y—Y nearer to or further from the axis X—X according to the double arrow F of FIG. 1. These means are indicated diagrammatically in FIG. 1 by a radial arm 15 for supporting the gripping means 13. The arm is articulated on a fixed shaft 16 parallel to the axes X—X and Y—Y and is located outside the plane which the axes define (which is the plane of FIG. 1).

In order to route the blank 14 to the profile of the selected spectacle frame, the blank is fastened by the means 13 in the appropriate position with respect to the center of the blank, and the latter is rotated slowly about the axis Y—Y, whilst being positioned at a predetermined distance from the axis X—X. The distance from the axis X—X is variable as a function of the angular position of the blank about the axis Y—Y.

The blank thus engages the peripheral surface of the abrasive layer 3 and is thereby brought to the desired configuration.

At the outset, the blank is substantially centered in relation to the length of the grinding wheel. It is found that, after a large number of blanks of different types have been routed, the middle region of the grinding wheel undergoes the most wear.

The portion 8 of greatest thickness is centered the length of the grinding wheel, in such a way that it is essentially this portion 8 which is stressed.

This results, at the expense of a slight increase in the volume of abrasive material and therefore of moderate cost, in a substantial lengthening of the life of the grinding wheel which, for the whole of this life, preserves a peripheral surface, the shape of which is close to that of a cylinder.

In fact, the shape of the extra thickness of the layer 3, as compared with the conventional cylindrical shape of a constant thickness e1, is approximately symmetrical with respect to a curve C which corresponds to the shape which the layer 3 would assume, after wear, in the absence of the extra thickness.

Experience shows that, for various reasons connected, in particular, with the practices of their region or their country, opticians treat spectacles or glasses of different types statistically.

Figure 3:
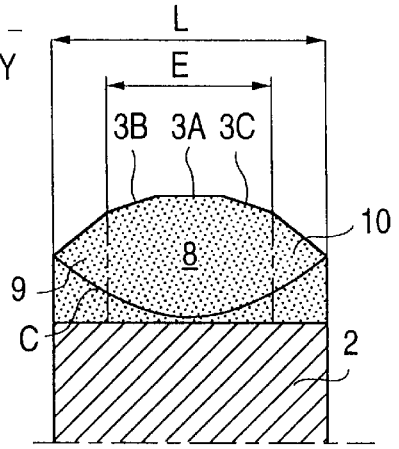
FIGS. 3–4 are views, similar to that of FIG. 2, of two variants of the present invention.

Thus, the wear curve C may have a deeper U shape and extend from one end of the grinding wheel to the other (FIG. 3). In such a case, it is advantageous to adopt a shape, illustrated in FIG. 3, which is substantially symmetrical with respect to this form of wear for the outer profile of the layer 3. For the sake of more convenient production, the theoretical curve is approached by a succession of segments of a straight line, five in number in the illustrated example, where the middle segment 3A is parallel to the axis X—X. Since the adjacent segments 3B, 3c are inclined slightly relative to this axis, the segments 3A to 3C may be considered as defining together a middle portion 8 of approximately constant thickness and of length E, bordered by two portions 9, 10 of clearly variable thickness.

If the meridian cross-section of the blank 14 (FIG. 1) is examined in more detail, it is found that, as compared with the middle of its peripheral edge, it comprises more material on one side (the left-hand side in FIG. 1) than on the other side. Also, the same is true of convergent or convex glass having a thin edge. Consequently, the actual wear of the abrasive layer 3 is, in fact, offset slightly to the left in relation to the middle of the length L. Alternatively, in a corresponding way, the portion 8 of maximum thickness of the layer 3 may be offset slightly in the same direction in relation to the middle of the length L, as illustrated in the embodiment of FIG. 4.

Figure 4:
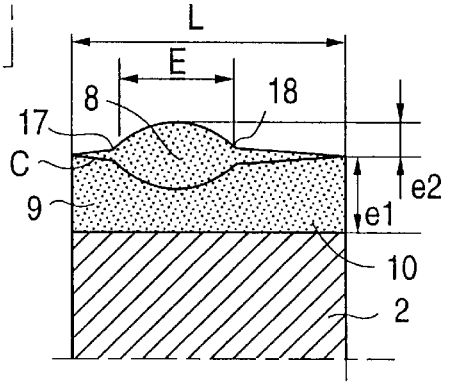

In FIG. 4, the extra thickness is, once again, symmetrical with respect to the wear curve C which, in this case, possesses substantial deflection virtually only over the abovementioned length E. The portion 8 is thus framed by two portions 9, 10 each of which has a thickness substantially equal to e1. In the example shown in FIG. 4, the convex profile of the portion 8, together with its adjacent concave connections of transition portions, 17, 18 is a curve without any angular points.

What is claimed is:

1. A grinding wheel for grinding ophthalmic lenses, said grinding wheel comprising:

a disc-shaped core having a central axis; and a diamond-charged abrasive layer formed on a peripheral surface of said disc-shaped core, said abrasive layer defining an outer convex surface of said grinding wheel before any of said abrasive layer is worn away by grinding of the ophthalmic lenses, wherein a longitudinal cross section through said grinding wheel reveals a longitudinal profile of said abrasive layer which has a convex portion which extends over ⅕ to ⅘ of an axial length of said grinding wheel, and said convex portion of said longitudinal profile is framed by two end portions which are substantially parallel to said axis.

2. The grinding wheel as claimed in claim 1, wherein said convex portion of said longitudinal profile defines an intermediate outer surface which is substantially parallel to said central axis of said core, and said abrasive layer progressively tapers away from either side of said intermediate outer surface, toward axial ends of said core.

3. The grinding wheel as claimed in claim 2, wherein said axial length of said convex portion represents between ⅓ to ⅔ of said axial length of said grinding wheel.

4. The grinding wheel as claimed in claim 1, wherein said two end portions are located substantially at the same distance from said central axis.

5. The grinding wheel as claimed in claim 1, wherein said abrasive layer has an overall profile which is asymmetrical with respect to a plane which is perpendicular to said longitudinal axis of said grinding wheel and contains a center of said grinding wheel.

6. The grinding wheel as claimed in claim 1, wherein said abrasive layer has an overall profile which is symmetrical with respect to a plane which is perpendicular to said longitudinal axis of said grinding wheel and contains a center of said grinding wheel.

7. The grinding wheel as claimed in claim 1, wherein said longitudinal profile revealed by said longitudinal cross-section is formed by a succession of straight line segments.

8. A grinding wheel for grinding ophthalmic lenses, said grinding wheel comprising:

a disc-shaped core having a central axis; and a diamond-charged abrasive layer formed on a peripheral surface of said disc-shaped core, said abrasive layer defining an outer convex surface of said grinding wheel before any of said abrasive layer is worn away by grinding of the ophthalmic lenses, wherein a longitudinal cross section through said grinding wheel reveals a longitudinal profile of said abrasive layer which has a convex portion which extends over at least ⅕ of an axial length of said grinding wheel, and wherein an extra thickness forming said convex portion of said abrasive layer is substantially symmetrical with respect to a wear curve calculated from abrasive layer wear data of a grinding wheel having a cylindrical outer peripheral surface.

9. A grinding wheel for grinding ophthalmic lenses, said grinding wheel comprising:

a disc-shaped core having a central axis; and a diamond-charged abrasive layer formed on a peripheral surface of said disc-shaped core, said abrasive layer defining an outer convex surface of said grinding wheel before any of said abrasive layer is worn away by grinding of the ophthalmic lenses, wherein a longitudinal cross section through said grinding wheel reveals a longitudinal profile of said abrasive layer which has a convex portion which extends over at least ⅕ of an axial length of said grinding wheel, and wherein an extra thickness forming said convex portion of said abrasive layer, as compared with a grinding wheel having a cylindrical outer peripheral surface, is substantially between 0.2 and 1 mm.

10. The grinding wheel as claimed in claim 9, wherein said extra thickness is substantially 0.5 mm.

11. A machine for grinding ophthalmic lenses, said machine comprising:

a shaft having a central axis;

a drive means for rotating said shaft about the shaft central axis;

a grinding wheel mounted on said shaft so as to be rotatable upon rotation of said shaft, said grinding wheel including a disc-shaped core having an central axis, a diamond-charged abrasive layer provided on an outer peripheral surface of said core, said abrasive layer defining an outer convex surface of said grinding wheel before any of said abrasive layer is worn away by grinding of the ophthalmic lenses, wherein a longitudinal cross section through said grinding wheel reveals a longitudinal profile of said abrasive layer which has a convex portion which extends over at least ⅕ of an axial length of said grinding wheel; and supporting means for supporting an ophthalmic lens adjacent to said grinding wheel, said supporting means comprising means for causing the lens to rotate about a supporting axis which is parallel to said shaft axis, and means for varying a distance between said supporting axis and said axis of said shaft as a function of an angular position of the lens about said supporting axis.

12. The machine as claimed in claim 11, wherein said convex portion of said longitudinal profile defines an intermediate outer surface which is substantially parallel to said central axis of said core, said convex portion having an axial length which represents between ⅕ to ⅘ of the axial length of said grinding wheel, and said abrasive layer progressively tapers away from either side of said intermediate surface toward axial ends of said core.

13. The machine as claimed in claim 12, wherein said axial length of said convex portion of said longitudinal profile represents between ⅓ to ⅔ of said axial length of said grinding wheel.

14. The machine as claimed in claim 11, wherein said convex portion of said longitudinal profile extends over a portion having an axial length which represents between ⅕ and ⅘ of an axial length of said grinding wheel.

15. The machine as claimed in claim 14, wherein said axial length of said convex portion represents between ⅓ and ⅔ of said axial length of said grinding wheel.

16. The machine as claimed in claim 14, wherein said convex portion is framed by two end portions which are substantially parallel to said central axis.

17. The machine as claimed in claim 16, wherein said two end portions are located substantially at the same distance from said central axis.

18. The machine as claimed in claim 14, wherein said abrasive layer has an overall profile which is symmetrical with respect to a plane that is perpendicular to said longitudinal axis of said grinding wheel and contains a center of said grinding wheel.

19. The machine as claimed in claim 11, wherein said abrasive layer has an overall profile which is asymmetrical with respect to a plane that is perpendicular to said longitudinal axis of said grinding wheel and contains a center of said grinding wheel.

20. The machine as claimed in claim 11, wherein said longitudinal profile revealed by said longitudinal cross-section is formed by a succession of straight line segments.

21. The machine as claimed in claim 11, wherein an extra thickness forming said convex portion of said abrasive layer is substantially symmetrical with respect to a wear curve calculated from abrasive layer wear data of a grinding wheel having a cylindrical outer peripheral surface.

22. The machine as claimed in claim 11, wherein an extra thickness forming said convex portion of said abrasive layer, as compared with a grinding wheel having a cylindrical outer peripheral surface, is substantially between 0.2 and 1 mm.

23. The machine as claimed in claim 22, wherein said extra thickness is substantially 0.5 mm.

* * * * *